United States Patent [19]

Lang et al.

[11] Patent Number: 4,653,726

[45] Date of Patent: Mar. 31, 1987

[54] VALVE SPRING RETAINER/LOCKING ASSEMBLY

[75] Inventors: Werner Lang, Calw; Jürgen Kretschmer, Stuttgart, both of Fed. Rep. of Germany

[73] Assignee: Daimler-Benz Aktiengesellschaft, Fed. Rep. of Germany

[21] Appl. No.: 836,485

[22] Filed: Mar. 5, 1986

[30] Foreign Application Priority Data

Mar. 9, 1985 [DE] Fed. Rep. of Germany ..... 3508549

[51] Int. Cl.[4] ..... F01L 3/00

[52] U.S. Cl. ..... 251/337; 123/188 SB; 123/188 SC; 251/368

[58] Field of Search ..... 123/188 SB, 188 SC; 251/337, 368

[56] References Cited

U.S. PATENT DOCUMENTS 4,432,311 2/1984 Holtzberg et al. ..... 123/188 SB
4,515,346 5/1985 Gaterman, III ..... 251/337

FOREIGN PATENT DOCUMENTS 3201023 7/1983 Fed. Rep. of Germany .
541989 5/1922 France .

*Primary Examiner*—A. Michael Chambers
*Attorney, Agent, or Firm*—Barnes & Thornburg

[57] ABSTRACT

A valve spring retainer and locking assembly comprising a locking member which is made screen-like and engages at least one peripheral groove of a valve stem end in a manner known per se employing a bulge, and is pressed against the valve stem end via a conical outer surface in interaction with a valve spring retainer. The locking member has the conical outer surface on the outer periphery of an umbrella-like support surface and also has a cylindrical contact surface with the valve stem on the groove side facing towards the free valve stem end. The valve spring retainer is supported against the screen of the locking member, is made of fiber-reinforced plastic and in the area of the conical outer surface of the umbrella-like support surface has a conical step which leaves an impression on the run of the fibers and, in interaction with the conical outer surface of the locking member, presses the locking member against the stem.

10 Claims, 1 Drawing Figure

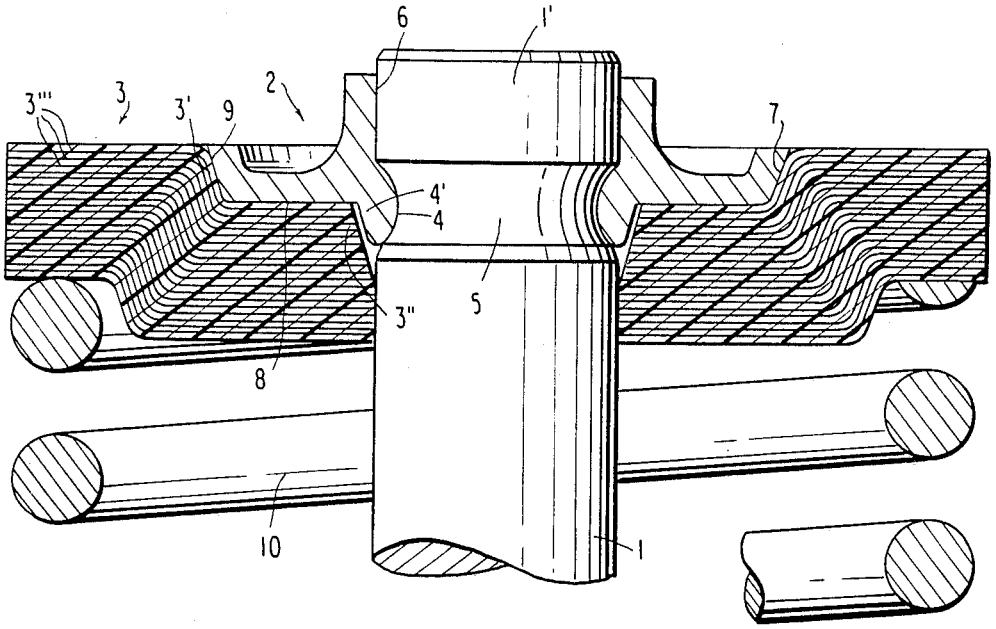
6
1'
3'''
3
3'
9
2
7
4'
4
5
3''
8
10
1

VALVE SPRING RETAINER/LOCKING ASSEMBLY

The invention relates to a valve spring retainer and locking assembly for engine poppet valves. Such assemblies consist of a valve spring retainer for supporting the valve springs, which valve spring retainer is fixed to the end of the valve stem by means of locking member. The locking member has a cylindrical contact surface towards the valve stem and is also provided on the inside with at least one bulge or rib which engages in a corresponding peripheral groove of the valve stem end. Further, the locking member has at least one conical outer surface. The valve spring retainer has at least one conical inner surface corresponding to the conical outer surface of the locking member and is supported against the locking member. By the interaction of the two conical surfaces, the locking member is pressed against the valve stem end and is consequently locked on the valve stem. Such valve spring retainer and locking assemblies are known in numerous embodiments, for example from German Offenlegungsschrift No. 1,576,421 or German Auslegeschrift No. 2,521,395. Because of the high forces which occur, the locking assembly is normally made of metal, which, however, leads to high oscillating masses as a result of the high specific weight of metal.

The object of the invention is to provide a valve spring retainer and locking assembly which can be manufactured inexpensively and enables a considerable saving in weight to be made compared with the prior art locking assemblies.

It is an object of the invention to provide a valve spring retainer and locking assembly which avoids the difficulties obtaining in the prior art.

It is another object of the invention to provide a valve spring retainer and locking assembly for a valve stem having a locking member with at least one conical outer surfaces which engages in at least one peripheral groove of a valve stem end of the valve stem and has a cylindrical contact surface facing the valve stem on the groove side facing the valve stem end with a valve spring retainer engaging the locking member having at least one conical inner surface engaging the conical outer surface to press the locking member against the valve stem end wherein the locking member has an umbrella-like support surface with said conical outer surface disposed on the outer periphery of the said support surface, the spring retainer supported against the support surface of the locking member being made of fiber-reinforced plastic and in the area of the conical outer surface of the support surface has a conical step which also leaves an impression on the run of the fibers and forms the conical inner surface.

It is another object of the invention to provide a valve spring retainer and locking assembly wherein a cylindrical contact surface of the locking member projects beyond the conical outer surface in a direction away from a groove in the valve stem and in the direction of a valve stem end.

It is another object of the invention to provide a valve spring retainer and locking assembly wherein a conical outer surface of a locking member and a groove are arranged in approximately the same axial position along the valve stem.

These and other objects, features, and advantages of the present invention will become more apparent from the following description when taken in connection with the accompanying drawing which shows, for the purposes of illustration only, one embodiment in accordance with the present invention, and wherein like reference numerals are used to designate like parts, the end of the valve stem 1, the locking member generally designated as 2 and the valve spring retainer generally designated as 3 are shown in section in the assembled condition. The valve stem end 1 has a groove 5, into which the bulge or rib 4 of the locking member 2 engages. Moreover, the locking member 2 is provided with a conical outer surface 7 and with a cylindrical contact surface 6 on the groove side facing towards the free valve stem end 1'. The valve spring retainer 3 is supported against the umbrella-like support surface 8 of the locking member 2 and, under the effect of the spring 10, presses the locking member 2 against the valve stem end 1' by means of its conical inner surface 9 in interaction with the conical outer surface 7 of the locking member 2. The tilting moment produced in the locking member 2 by the valve spring retainer 3 is induced into the valve stem end 1' via the cylindrical contact surface 6 of the locking member 2, which contact surface 6 is made as a coller. At the same time, it is of particular advantage and the structure is particularly reliable if the cylindrical contact surface 6 of the locking member 2 projects beyond the conical outer surface 7 in the direction of the valve stem end 1'. It is also of advantage if the conical outer surface 7 of the locking member 2 and the projection or bulge 4 engaging into the groove 5 are arranged in approximately the same axial position, to effect space-saving and thus weightsaving construction.

The spring retainer 3 is made of fiber-reinforced plastic and, in the area of the conical outer surface 7 of the locking member 2, has a conical step 3' which also leaves an impression on the run of the fibers shown as parallel lines 3''' and forms the inner conical surface 9. Carbon fibers, glass fibers, oxide fibers, such as sluminum oxide fibers, or even synthetic fibers, such as aramide fibers, etc., can be used as reinforcing fibers for the spring retainer 3. The plastic matrix into which these fibers are embedded can be in the form of thermosetting resin (epoxide, polyimide and phenolic resin, etc.); but high-temperature thermo-plastics, such as polysulfone, polybutylene terephthalate, polypropylene sulphide, polyether-ketone, polyether-imide, polyether-sulfone, polyamide-imide, etc. can also be used. The reinforcing fibers in the spring retainer 3 are expediently arranged in layers, namely with a predetermined angular displacement of the individual fiber layers to one another. Normal angular displacements are about 30°. Such an angular displacement is known per se in the manufacture of fiber-reinforced objects and leads to a very uniform loading capacity of the component.

The step 3' on the spring retainer 3 is produced at the manufacturing stage by a fiber body (prepreg) which is impregnated with plastic prepolymer being correspondingly pressed in a mold and polymerized out, or by plastic being injected into a corresponding mold. It is also possible to polymerize a large prepreg mat in a mold into a plurality of corresponding spring retainer blanks and then later to cut off the corresponding spring retainers from this molded mat using methods per se, such as laser beam cutting or stamping. At the same time, it is of great importance during manufacture that the step 3 which forms the conical inner surface 3' of the spring retainer, also be impressed on the run of the fibers. Since the force initiation for pressing the locking member 2 against the valve stem 1 runs via this conical inner surface 3', force is consequently initiated at right angles to the fibers which are in parallel alignment, because only in this way can the high compressive stresses which occur be absorbed in the long term. For the same reason, the two conical surfaces 3" and 4' made directly at the bulge 4 engaging the groove 5 are formed such that no compressive forces whatsoever develop in this location between the locking member 2 and the valve spring retainer 3. The locking member 2 is therefore merely bevelled at 4' to achieve better strength in this location by greater material thickness, and the bevelling in the valve spring retainer 3" creates the necessary space for this purpose. In principle, however, these two bevels 3" and 4' are not used to press the locking member 2 against the valve stem 1. The locking member 2 is made in two pieces in normal manner—which is not shown in detail in the drawing. However, embodiments having a one-piece locking member 2 are also conceivable which are pushed onto the valve stem end 1' through a correspondingly large eccentric bore (not shown) and are fixed by lateral displacement in the groove 5. However, as a result of the comparatively large bore necessary, the one-piece arrangements are not as robust mechanically as a two-piece locking member 2.

The advantages which can be achieved by means of the invention comprise a clear reduction in the weight for the valve spring retainer and locking assembly, which can be up to 75% compared with the conventional all-metal method of construction. Because of this reduction in weight, the oscillating masses are reduced quite considerably, which allow higher speeds, to a lower noise level of the valve drive and in addition allow "steeper" cam forms, depending on the design of the engine.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A valve spring retainer and locking assembly for a valve stem having a locking member having at least one rib surface which engages in at least one peripheral groove of a valve stem end of said valve stem and has a cylindrical contact surface facing the valve stem on the groove side facing the valve stem end, a valve spring retainer engaging the locking member having at least one conical inner surface engaging a conical outer surface of the locking member to press the locking member against the valve stem end, wherein the locking member has an umbrella-like support surface with said conical outer surface disposed on the outer periphery of the said support surface and the spring retainer supported against the support surface of the locking member is made of fiber-reinforced plastic and in the area of the conical outer surface of the support surface has a conical step which also leaves an impression on the run of the fibers and forms the conical inner surface.

2. Valve spring retainer and locking assembly according to claim 1, wherein the cylindrical contact surface of the locking member projects beyond the conical outer surface in a direction away from the groove and in the direction of the valve stem end.

3. Valve spring retainer and locking assembly according to claim 1 wherein the conical outer surface of the locking member and the at least one groove are arranged in approximately the same position on an axis of the valve stem.

4. A valve spring retainer locking assembly consisting of a locking member arranged around a valve stem, said locking member, on an interior side, having at least one projection that engages in at least one circumferential groove of a free valve stem end and having a cylindrical contact surface to the valve stem on the side of the groove facing the free valve stem end and also having at least one conical exterior surface, and a valve spring retainer having at least one conical interior surface via which it is supported in the direction of the valve stem end against the conical exterior surface of the locking member, wherein the locking member is developed in an umbrella shape and the conical exterior surface of the locking member is disposed at an outer circumference of the umbrella, and wherein the spring retainer comprises a fiber-reinforced plastic and wherein the conical interior surface of the spring retainer is configured as a step, the geometry of which is also impressed on the fiber course in the area of the step.

5. A valve spring retainer locking assembly according to claim 4, wherein the cylindrical contact surface of the locking member projects beyond the conical exterior surface in the direction of the valve stem end.

6. Valve spring retainer and locking assembly according to claim 1 wherein the conical outer surface of the locking member and the at least one groove are arranged in approximately the same position on the axis of the valve stem.

7. A valve spring retainer and locking assembly for a valve stem having a locking member having a least one conical outer surface and which engages in at least one peripheral groove of a valve stem end of said valve stem and which has a cylindrical contact surface engaging the valve stem, the locking member having an umbrella-like support surface circumferential to an axis of said valve stem with an outer conical surface peripheral to said umbrella-like support surface, a valve spring retainer means comprising at least plural discrete layers of plastic reinforced with fiber, the run of the fibers in each layer being substantially parallel to the contiguous surface of the locking member, the valve spring retaining means having an inner conical surface means engaging the outer conical surface of the locking element for directing a force substantially at right angles to the run of the fibers to the outer conical surface of the locking member for producing a tilting moment in the locking member against the valve stem.

8. A valve spring retainer and locking assembly in accordance with claim 7, wherein the cylindrical contact surface of the locking members projects beyond the conical outer surface in a direction away from the groove and in the direction of the valve stem end.

9. A valve spring retainer and locking assembly in accordance with claim 7, wherein the conical outer surface of the locking member and the at least one groove are arranged in approximately the same axial position.

10. A valve spring retainer and locking assembly in accordance with claim 7, wherein the locking member has a second conical surface contiguous to said groove, and said valve spring retainer means has a second conical surface means spaced from said second conical surface of said locking member.

* * * * *